US008269588B2

(12) United States Patent
Sohn

(10) Patent No.: US 8,269,588 B2
(45) Date of Patent: Sep. 18, 2012

(54) CYLINDER TYPE BISTABLE PERMANENT MAGNETIC ACTUATOR

(75) Inventor: Jong-Mahn Sohn, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 343 days.

(21) Appl. No.: 12/636,159

(22) Filed: Dec. 11, 2009

(65) Prior Publication Data

US 2010/0164661 A1 Jul. 1, 2010

(30) Foreign Application Priority Data

Dec. 31, 2008 (KR) ..... 10-2008-0138627

(51) Int. Cl.
*H01F 7/00* (2006.01)

(52) U.S. Cl. ..... 335/229; 335/220

(58) Field of Classification Search ..... 335/229
See application file for complete search history.

(56) References Cited

U.S. PATENT DOCUMENTS

| | | | | |
|---|---|---|---|---|
| 4,041,430 | A * | 8/1977 | Hrynewycz | 336/92 |
| 4,558,293 | A * | 12/1985 | Haneda et al. | 335/255 |
| 4,679,767 | A * | 7/1987 | Vollmer et al. | 251/129.15 |
| 6,373,361 | B1 * | 4/2002 | Umemoto et al. | 335/220 |
| 6,816,048 | B2 * | 11/2004 | Morita et al. | 335/220 |
| 6,873,234 | B2 * | 3/2005 | Kyouno et al. | 335/278 |
| 6,943,655 | B1 * | 9/2005 | McMahon et al. | 335/202 |
| 7,367,932 | B2 * | 5/2008 | Niinai | 494/12 |
| 7,518,269 | B2 | 4/2009 | Lee | |
| 7,847,661 | B2 * | 12/2010 | Jotter et al. | 335/279 |
| 7,871,060 | B2 * | 1/2011 | Armour | 251/129.15 |

FOREIGN PATENT DOCUMENTS

| | | |
|---|---|---|
| JP | 57-121108 | 1/1981 |
| JP | 3-45609 | 4/1991 |
| JP | 6-251933 | 9/1994 |
| JP | 2001-008427 | 1/2001 |
| JP | 2001-61267 | 3/2001 |
| JP | 2002-153040 | 5/2002 |
| JP | 2004-227966 | 8/2004 |
| JP | 2004-247093 | 9/2004 |

OTHER PUBLICATIONS

U.S. Appl. No. 12/654,125 to Sohn et al., filed Dec. 11, 2009.
Korea Office action, mail date is Dec. 27, 2010.

* cited by examiner

*Primary Examiner* — Elvin G Enad
*Assistant Examiner* — Lisa Homza
(74) *Attorney, Agent, or Firm* — Greenblum Bernstein P.L.C.

(57) ABSTRACT

Disclosed is a cylinder type bistable permanent magnetic actuator, the bistable actuator including, a cylinder formed by rolling a thin plate so as to form an inner space, a mover reciprocatingly installed within the cylinder in a lengthwise direction of the cylinder, first and second coils installed near both end portions of the cylinder, respectively, by interposing the mover therebetween, and a permanent magnet installed between the first and second coils.

9 Claims, 4 Drawing Sheets

PRIOR ART

CYLINDER TYPE BISTABLE PERMANENT MAGNETIC ACTUATOR

CROSS-REFERENCE TO A RELATED APPLICATION

Pursuant to 35 U.S.C. §119(a), this application claims the benefit of earlier filing date and right of priority to Korean patent Application No. 10-2008-0138627, filed on Dec. 31, 2008, the contents of which is incorporated by reference herein in its entirety.

BACKGROUND OF THE INVENTION

1. Field of the Invention

The present invention relates to a cylinder type bistable permanent magnetic actuator, and particularly, to an actuator employed in power equipment for operating a circuit breaker or a switch.

2. Background of the Invention

Typically, a spring mechanism, a hydraulic actuator and a pneumatic actuator are used as actuators employed in power equipment. However, since such actuators require many components and should control mechanical energy for making a steering effort, they have a complicated structure and need to be repaired and maintained.

To solve such problems, an actuator employing permanent magnets and electric energy is used in the power equipment, instead of the existing mechanism. The permanent magnetic actuator is configured such that a mover thereof is held at a stroke due to magnetic energy of the permanent magnets, and electric energy is applied to a coil to move the mover to a stroke.

The permanent magnetic actuators may be categorized into a bistable type and a monostable type depending on a mechanism that the mover is held at a preset position. The bistable type permanent magnetic actuator is configured such that a mover can be held at each of both ends of a stroke due to permanent magnets, whereas the monostable type permanent magnetic actuator is configured such that a mover is held at only one of both ends of a stroke. Since the mover of the bistable type permanent magnetic actuator is held at a preset position by magnetic energy of permanent magnets upon opening or closing power equipment, it is more advantageous than the monostable type requiring for a separate maintenance mechanism, in that the bistable type can perform the closing/opening operation without a mechanical component such as a spring.

FIG. 1 shows an example of a bistable type permanent magnetic actuator according to the related art. The actuator includes an upper cylinder 10 having a groove in which a coil is to be disposed, an intermediate cylinder 12 located at a lower side of the upper cylinder 10, and a lower cylinder 14 located at a lower side of the intermediate cylinder 12. An inner cylinder 16 having a central portion in which a mover is to be inserted is installed inside the intermediate cylinder 12, and a permanent magnet 20 is installed at an upper surface of an edge of the inner cylinder 16.

Here, the mover 22 is installed to be reciprocated up and down between the upper cylinder 10 and the lower cylinder 14. Guide shafts 24 and 26 are coupled to upper surface and lower surface of the mover 22, respectively. The guide shafts 24 and 26 are inserted into guide holes formed in the respective upper and lower cylinders 10 and 14. An open spring 28 is installed at a lower portion of the guide shaft 26. The open spring 28 is configured to be compressed when the mover 22 is located at a lower side so as to upwardly apply an elastic force to the mover 12.

An upper coil 30 and a lower coil 32 are installed in the upper cylinder 10 and the lower cylinder 14, respectively.

An operation of the actuator will be described hereinafter. As shown in FIG. 1, in a state of being contacted with the lower cylinder 14, the mover 22 is held in the contacted state with the lower cylinder 14 by a magnetic flux generated by the permanent magnet 20. Under this state, upon applying a current to the upper coil 30, a magnetic force is upwardly applied to the mover 22. If the magnetic force becomes stronger, the mover 22 is moved upwardly so as to come in contact with the upper cylinder 10 as shown in FIG. 2. At this moment, the flow of the magnetic flux generated by the permanent magnet 20 is changed. Accordingly, the mover 22 is held at the upwardly moved position by the magnetic flux of the permanent magnet 20.

On the contrary, when the mover 22 is kept located at the position shown in FIG. 2 by the magnetic force of the permanent magnet, upon applying a current to the lower coil 32, a magnetic force is applied to the mover 22 downwardly. If the downwardly applied force becomes stronger than the force of the permanent magnet 20, the mover 22 is then moved downwardly so as to come in contact with the lower cylinder 14 as shown in FIG. 1. The contacted state is maintained by the magnetic force of the permanent magnet 20. The open spring 28 may apply an elastic energy to the mover, which is accordingly moved upwardly when manually opening a contact of an external power equipment in case where the actuator is connected to the power equipment (e.g., a circuit breaker or a switch).

However, the main components, i.e., upper cylinder, lower cylinder, intermediate cylinder and inner cylinder, constructing the related art actuator should be machined into the shape of hollow cylinders, thereby increasing the machining cost. Further, since the permanent magnet mounted onto the cylinder is formed in a ring shape having a large outer diameter, the cost required for fabricating the magnet is increased as well.

Besides, such components in the cylindrical shape should be assembled on the same shaft line, which causes difficulty in the assembly. Also, one permanent magnet attracts the mover. Accordingly, the magnet has a great magnetic force, so as to problematically attract other components during the assembling process.

SUMMARY OF THE INVENTION

Therefore, to overcome the drawbacks of the related art, an object of the present invention is to provide a bistable type permanent magnetic actuator capable of being fabricated more easily and reducing the fabricating cost.

Another object of the present invention is to provide a bistable permanent magnetic actuator capable of improving assembly by solving the problem occurred during the assembly due to a magnetic force of a permanent magnet, by allowing the use of permanent magnets each having a weaker magnetic force.

To achieve these and other advantages and in accordance with the purpose of the present invention, as embodied and broadly described herein, there is provided a bistable type actuator including, a cylinder formed by rolling a thin plate so as to form an inner space, a mover reciprocatingly installed within the cylinder in a lengthwise direction of the cylinder, first and second coils installed near both end portions of the cylinder, respectively, by interposing the mover therebetween, and a permanent magnet installed between the first and second coils.

In the one aspect of the present invention, the cylinder forming the outer appearance of the actuator may be formed by rolling a plate not by machining, which results in non-requirement of a separate machining.

Here, the actuator may further include an intermediate plate fixed into the cylinder and formed by laminating a plurality of thin plates, and the permanent magnet may be fixed to the intermediate plate. The intermediate plate is also formed by laminating plates produced in great quantities in a manner of stamping (blanking) an original material other than machining the same, thereby allowing an easy fabrication.

Here, the intermediate plate may have a rectangular outer appearance. Besides, the intermediate plate may have a prescribed form of polygon or closed curve.

Also, the intermediate plate may be provided with a through hole through which the mover is inserted, and the permanent magnet may be provided in plurality, so as to be fixed to an inner surface of the through hole. The use of the plurality of permanent magnets allows a magnetic force of each permanent magnet to be weaker than a magnetic force required for holding a mover, which results in facilitating the handling of the permanent magnets during an assembly process.

Here, magnetic flux attraction plates may be attached onto surfaces of the plurality of permanent magnets, respectively, and each of the magnetic flux attraction plates may be formed by laminating a plurality of thin plates.

In another aspect of the present invention, there is provided a bistable type actuator including, first and second cylinders each formed by rolling a thin plate so as to form an inner space; an intermediate plate disposed between the first and second cylinders, the intermediate plate having a through hole connected to the inner spaces of the first and second cylinders, a mover reciprocatingly installed within the first and second cylinders and the intermediate plate in a lengthwise direction of the cylinders, first and second coils installed at the first and second cylinders, respectively, by interposing the mover therebetween, a permanent magnet installed in the intermediate plate, and fixing elements configured to maintain the coupled state among the first and second cylinders and the intermediate plate.

Here, the intermediate plate may be formed by laminating a plurality of thin plates, and have a rectangular outer appearance.

The permanent magnet may be installed inside the through hole of the intermediate plate. Also, the permanent magnet may be provided in plurality, so as to be disposed inside the through hole of the intermediate plate. Here, the magnetic force of each permanent magnet may be weaker than a minimum magnetic force required for holding the mover. In addition, magnetic flux attraction plates may be attached onto surfaces of the plurality of permanent magnets, respectively, and each of the magnetic flux attraction plates may be formed by laminating a plurality of thin plates.

The fixing elements may include first and second fixed plates disposed outside the first and second cylinders, respectively, and fixing members configured to apply an attractive force between the first and second fixing plates. The fixing members may include a fixed shaft extending between the first and second fixing plates, and fixing nuts fixed to both ends of the fixed shaft.

In accordance with the aspects of the present invention having such configurations, the cylinders are formed by rolling a plate not by machining, thereby being easily fabricated due to non-requirement of the machining. Also, use of a plurality of permanent magnets each having a weak magnetic force, instead of one permanent magnet having a strong magnetic force, facilitates handling of the permanent magnets, resulting in improvement of assembly.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of a bistable type permanent magnetic actuator in accordance with one embodiment of the present invention, with reference to the accompanying drawings.

Figure 1:
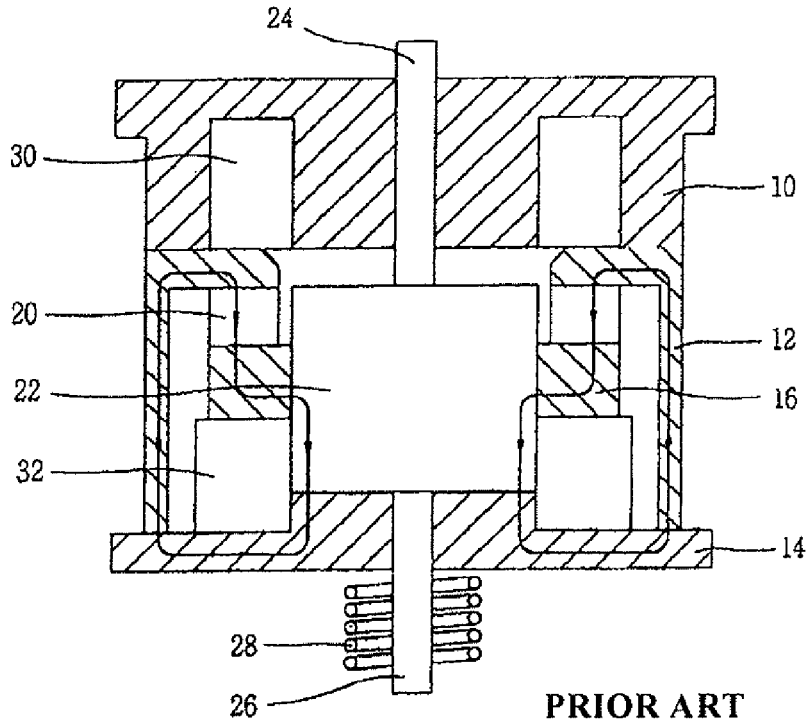
FIGS. 1 and 2 are cross-sectional views showing an internal structure of a bistable type permanent magnetic actuator in accordance with the related art.
Figure 2:
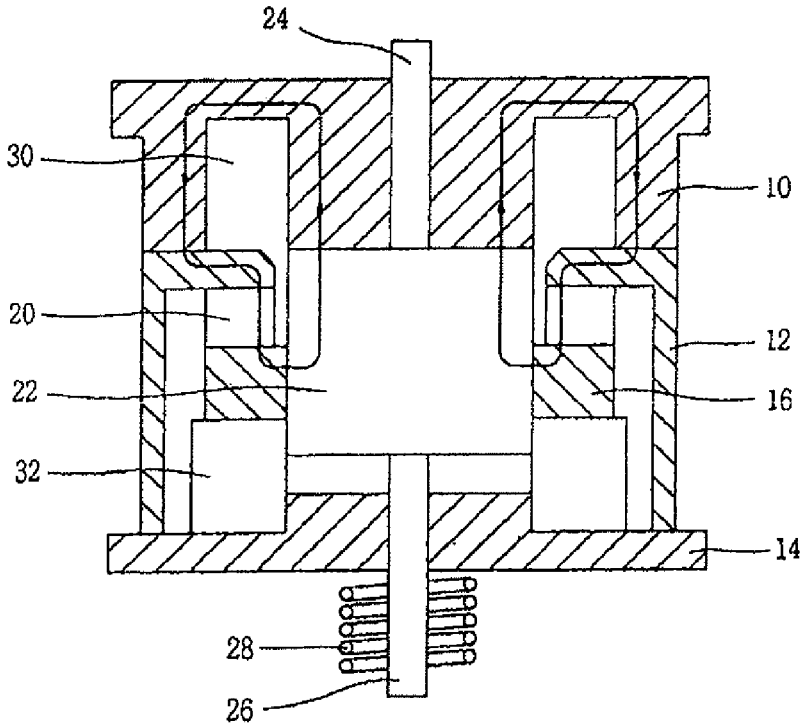
PRIOR ART Fig. 2
Figure 3:
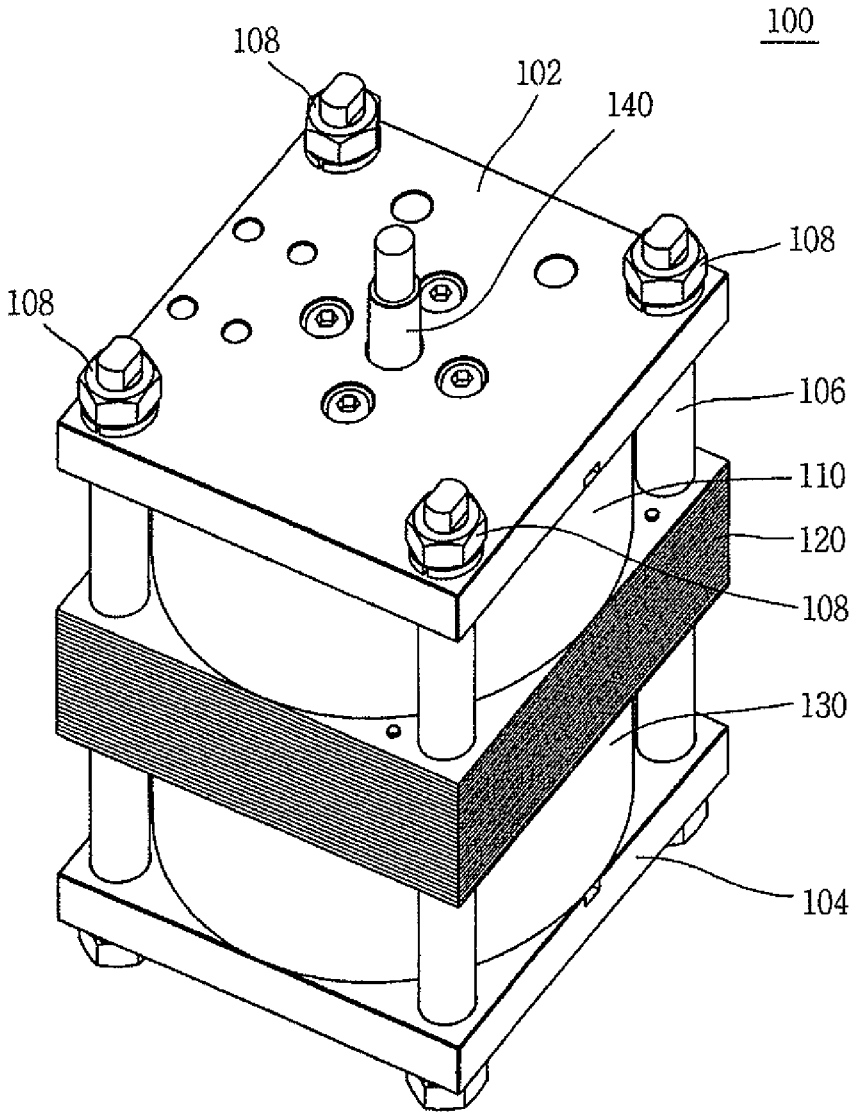
FIG. 3 is a perspective view showing one embodiment of a bistable type permanent magnetic actuator in accordance with the present invention.

Referring to FIG. 3, an actuator 100 in accordance with one embodiment of the present invention is shown. The actuator 100 may include first and second fixed plates 102 and 104 fixed to uppermost and lowermost ends by sequentially interposing a first cylinder 110, an intermediate cylinder 120 and a second cylinder 130 therebetween.

Here, the first cylinder 110, the intermediate cylinder 120 and the second cylinder 130 may be fixed by the first and second fixed plates 102 and 104, thereby preventing separation thereof. Four fixing bolts 106 may be disposed near each vertex between the first and second fixed plates 102 and 104. Fixing nuts 108 may then be coupled to ends of the fixing bolts 106, so as to apply an attractive force between the first and second fixed plates 102 and 104.

Here, each of the first and second cylinders 110 and 130 may be configured to have a cylindrical shape by rolling a plate plural times in a cylindrical shape, and the intermediate plate 120 may be configured by laminating a plurality of rectangular plates, thereby serving to fix permanent magnets to be explained later. The first cylinder 110, the intermediate cylinder 120 and the second cylinder 130 are coupled so as to implement an outer appearance of the actuator 100 according to the one embodiment. A bushing 140 may be fixedly disposed at a central portion of the first fixed plate 102, and an end portion of an upper shaft of a mover may be inserted into the bushing 140, thereby allowing a more smooth movement of the mover.

Hereinafter, an internal structure of the actuator according to the one embodiment will be described with reference to FIG. 4.

A mover 150 may be mounted to be movable up and down within inner spaces of the first and second cylinders 110 and 130 and an inner space defined by a through hole 122 formed through the intermediate plate 120. An upper shaft 152 and a lower shaft 154 may be coupled to both ends of the mover 150, and a gap ring 156 may be inserted into the upper shaft 152. The gap ring 156 may allow the mover 150 to be spaced apart from an upper core, which will be explained later, by a prescribed gap.

Meanwhile, a bobbin 160 may be inserted into each of the first and second cylinders 110 and 130, and an upper coil 162 and a lower coil 166 may be wound on the bobbins 160, respectively. Further, an upper core 164 and a lower core 168 may be inserted into end portions of the bobbins 160, respectively. The upper and lower cores 164 and 168 may be magnetized by a current applied to the upper coil 162 and the lower coil 166, so as to serve to move the mover 150.

Permanent magnet fixing members 170 for press-welding each permanent magnet may be installed near vertexes of the inner space of the intermediate plate 120. Each permanent magnet fixing member 170 may substantially have a rectangular shape, and have protrusions 172 formed at corners thereof. The protrusions 172 may allow the permanent magnet fixing members 170 to be stably fixed into the intermediate plate 120 by being inserted into corresponding grooves 124 formed near the vertexes of the intermediate plate 120.

A permanent magnet 180 may be inserted between the neighboring permanent magnet fixing members 170. The permanent magnet 180 may be fixed in a state of being pressed by the pair of permanent magnet fixing members 170. A magnetic flux attraction plate 182 may be attached onto a surface of each permanent magnet 180, which faces the center of the intermediate plate 120. The magnetic flux attraction plate 182 may be formed by laminating a plurality of plates each having one side surface formed in an arcuate shape, so as to serve to attract the magnetic flux generated by the permanent magnet 180.

Figure 4:
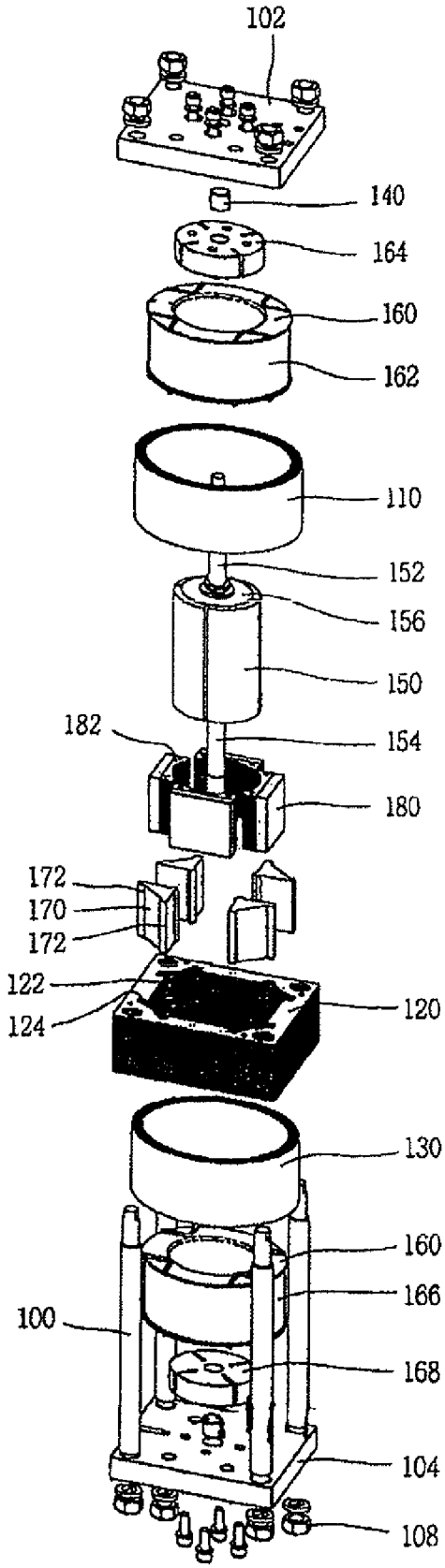
FIG. 4 is a disassembled perspective view of the embodiment shown in FIG. 3.

In the embodiment shown in FIGS. 3 and 4, the intermediate plate was configured to be located between two cylinders; however, without a limit to the embodiment, another embodiment may be considered that the intermediate plate may be installed inside one of cylinders.

Hereinafter, an operation of the actuator in accordance with the one embodiment will be described with reference to FIG. 5.

Figure 5:
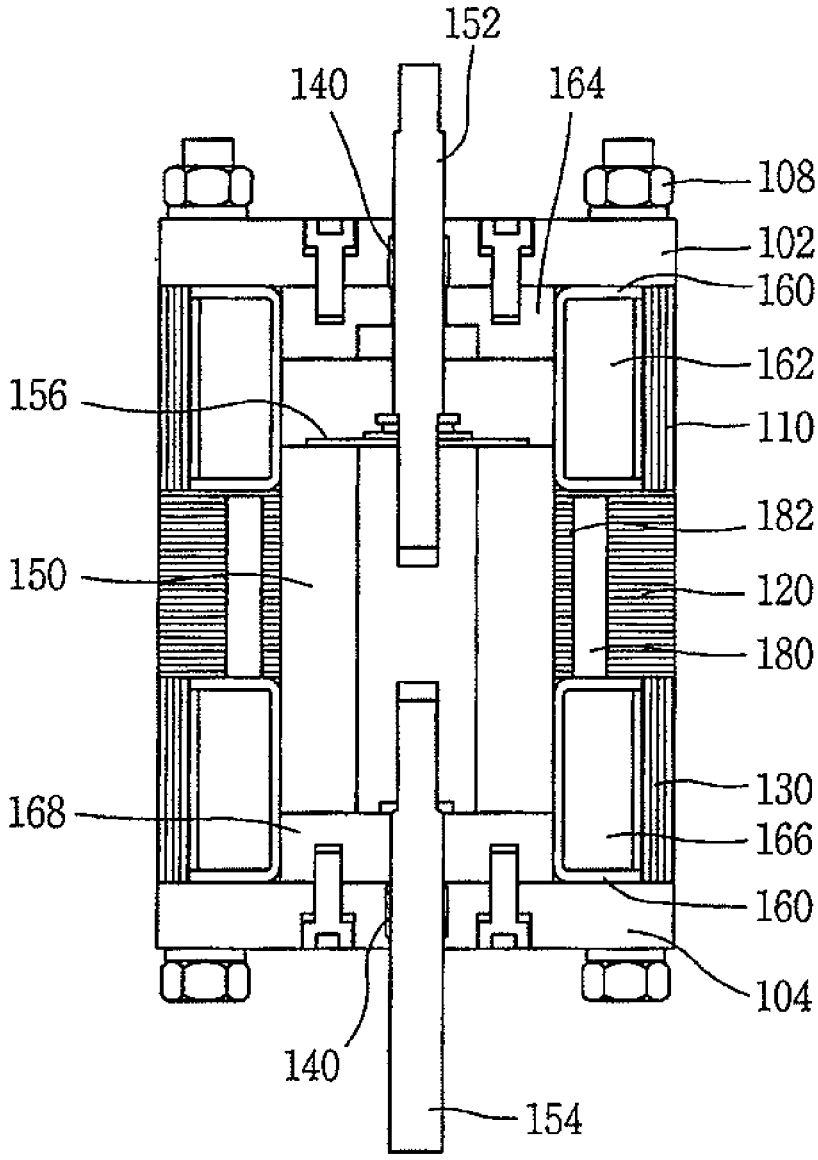
FIG. 5 is a cross-sectional view of the embodiment shown in FIG. 3.

Referring to FIG. 5, the mover 150 is held with being closely adhered to the lower core 168, which is allowed by a magnetic force of each permanent magnet 180. Under this state, upon applying a current to the upper coil 162, the upper core 164 is magnetized so as to apply a magnetic force to the mover 150. If such magnetic force is gradually increased to be stronger than the magnetic force of each permanent magnet 180, the mover 150 is moved toward the upper core 164. Accordingly, the mover 150 can be held in the upwardly moved state by the magnetic force of each permanent magnet 180 under the state where the gap ring 156 is contacted with the upper core 164.

Here, a force allowing the mover 150 to be held at an upper position is weaker than a force allowing the mover 150 to be held at a lower position because an air gap is formed between the upper core 164 and the mover 150 due to the gap ring 156.

On the contrary, if a current is applied to the lower coil 166 in the state of the mover 150 being held at the upper position, the lower core 168 is magnetized so as to downwardly apply a magnetic force to the mover 150. If the magnetic force of the lower core 168 is increased to be stronger than the magnetic force of each permanent magnet 180, which allows the mover 150 to be held at the upper position, the mover 150 is moved downwardly so as to be returned to the state shown in FIG. 5. Afterwards, even if the current applied to the lower coil 166 is blocked, the magnetic force of each permanent magnet 180 is applied to the lower core 166, so the mover 150 can be maintained in the state shown in FIG. 5.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A bistable actuator, comprising:

a cylinder formed by rolling a thin plate so as to form an inner space;

a mover reciprocatingly installed within the cylinder in a lengthwise direction of the cylinder;

first and second coils installed near both end portions of the cylinder, respectively, by interposing the mover therebetween;

an intermediate plate fixed into the cylinder and formed by laminating a plurality of thin plates;

and a plurality of permanent magnets fixed to the intermediate plate between the first and second coils, wherein the intermediate plate has a rectangular outer appearance and is provided with a through hole through which the mover is inserted, wherein the plurality of permanent magnets are fixed to an inner surface of the through hole, and wherein magnetic flux attraction plates are attached onto surfaces of the plurality of permanent magnets, respectively, each of the magnetic flux attraction plates being formed by laminating a plurality of thin plates.

2. A bistable actuator, comprising:

first and second cylinders each formed by rolling a thin plate so as to form an inner space;

an intermediate plate disposed between the first and second cylinders, the intermediate plate having a through hole connected to the inner spaces of the first and second cylinders;

a mover reciprocatingly installed within the first and second cylinders and the intermediate plate in a lengthwise direction of the first and second cylinders;

first and second coils installed at the first and second cylinders, respectively, by interposing the mover therebetween;

a permanent magnet installed in the intermediate plate; and fixing elements configured to maintain the coupled state among the first and second cylinders and the intermediate plate, wherein the fixing elements comprise first and second fixing plates disposed outside the first and second cylinders, respectively, and fixing members configured to apply an attractive force between the first and second fixing plates.

3. The actuator of claim 2, wherein the intermediate plate is formed by laminating a plurality of thin plates.

4. The actuator of claim 3, wherein the intermediate plate has a rectangular outer appearance.

5. The actuator of claim 2, wherein the permanent magnet is installed inside the through hole of the intermediate plate.

6. The actuator of claim 5, wherein the permanent magnet is provided in plurality, so as to be disposed inside the through hole of the intermediate plate.

7. The actuator of claim 6, wherein magnetic flux attraction plates are attached onto surfaces of the plurality of permanent magnets, respectively, each of the magnetic flux attraction plate being formed by laminating a plurality of thin plates.

8. The actuator of claim 6, wherein the magnetic force of each permanent magnet is weaker than a minimum magnetic force required for holding the mover.

9. The actuator of claim 2, wherein the fixing members comprise:

a fixed shaft extending between the first and second fixing plates; and fixing nuts fixed to both ends of the fixed shaft.

* * * * *